US007094015B2

(12) United States Patent
Hohmann et al.

(10) Patent No.: US 7,094,015 B2
(45) Date of Patent: Aug. 22, 2006

(54) DEVICE FOR CONVEYING EMPTY ROLLS

(75) Inventors: Lothar Franz Hohmann, Erlabrunn (DE); Klaus Walter Röder, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 64 days.

(21) Appl. No.: 10/496,305

(22) PCT Filed: Nov. 27, 2002

(86) PCT No.: PCT/DE02/04341

§ 371 (c)(1),
(2), (4) Date: Jun. 2, 2004

(87) PCT Pub. No.: WO03/048015

PCT Pub. Date: Jun. 12, 2003

(65) Prior Publication Data

US 2005/0092864 A1 May 5, 2005

(30) Foreign Application Priority Data

Dec. 4, 2001 (DE) ..... 101 59 520

(51) Int. Cl.
*B65H 67/00* (2006.01)

(52) U.S. Cl. ..... 414/404; 414/419; 414/425; 242/533.1; 242/533.2

(58) Field of Classification Search ..... 414/403–406, 414/407, 425; 242/559–560, 57, 473.9, 533, 242/68.7, 557; 57/266, 268, 272

See application file for complete search history.

(56) References Cited

U.S. PATENT DOCUMENTS

| | | | | | |
|---|---|---|---|---|---|
| 3,107,873 | A | * | 10/1963 | Greding | 242/533.2 |
| 3,247,661 | A | * | 4/1966 | King, Jr. et al. | 57/272 |
| 3,406,925 | A | * | 10/1968 | Waterhouse | 242/533.2 |
| 3,658,199 | A | * | 4/1972 | Owen, Jr. | 414/425 |
| 3,679,077 | A | * | 7/1972 | Gennick | 414/303 |
| 3,729,915 | A | * | 5/1973 | Mayer et al. | 57/271 |
| 3,753,593 | A | * | 8/1973 | Wells et al. | 298/10 |
| 3,972,487 | A | * | 8/1976 | Costa | 242/558 |
| 3,978,999 | A | * | 9/1976 | Ryder | 414/421 |
| 4,298,173 | A | * | 11/1981 | Johansson | 242/558 |
| 4,324,523 | A | * | 4/1982 | Zablocky | 414/796.2 |
| 4,752,176 | A | * | 6/1988 | Linder | 414/278 |
| 5,067,871 | A | | 11/1991 | Hilber | |
| 5,085,377 | A | | 2/1992 | Rohrer et al. | |
| 5,096,355 | A | * | 3/1992 | Schroder | 414/273 |
| 5,209,418 | A | * | 5/1993 | Alexander, III | 242/558 |

(Continued)

FOREIGN PATENT DOCUMENTS

DE 25 27 778 A1 12/1976

(Continued)

*Primary Examiner*—Eileen D. Lillis
*Assistant Examiner*—Charles Greenhut
(74) *Attorney, Agent, or Firm*—Jones, Tullar & Cooper, P.C.

(57) ABSTRACT

A device is used to convey empty rolls that have been removed by at least one roll changer of a web-fed rotary printing press. At least one empty roll receptacle can be displaced between the roll changer, where the empty rolls are held by the receptacle after they are removed by the roll changer, and an emptying station where the empty rolls are removed from the receptacle. A collection receptacle is provided at the emptying station. The empty rolls are emptied from the empty roll receptacle to the collection receptacle.

10 Claims, 3 Drawing Sheets

U.S. PATENT DOCUMENTS

| | | | | | |
|---|---|---|---|---|---|
| 5,226,611 | A | * | 7/1993 | Butterworth et al. | 242/527 |
| 5,330,308 | A | * | 7/1994 | Armando et al. | 414/408 |
| 5,379,963 | A | * | 1/1995 | Stauber | 242/533.8 |
| 5,388,955 | A | * | 2/1995 | Schroder | 414/279 |
| 5,478,027 | A | * | 12/1995 | Alexander, III | 242/558 |
| 5,533,859 | A | * | 7/1996 | McHenry | 414/772 |
| 5,726,283 | A | * | 3/1998 | Tsai et al. | 528/354 |
| 5,762,283 | A | * | 6/1998 | Buchmeyer et al. | 242/532.3 |
| 6,059,520 | A | * | 5/2000 | Adams et al. | 414/800 |
| 6,138,938 | A | * | 10/2000 | Lehrieder et al. | 242/559.3 |
| 6,152,670 | A | * | 11/2000 | Onnerlov | 414/276 |
| 6,332,745 | B1 | * | 12/2001 | Duell et al. | 414/406 |
| 6,402,083 | B1 | | 6/2002 | Horn et al. | |
| 6,422,802 | B1 | * | 7/2002 | Herrin | 414/419 |
| 6,431,809 | B1 | * | 8/2002 | Teich | 414/286 |
| 6,652,213 | B1 | * | 11/2003 | Mitchell et al. | 414/284 |
| 6,820,837 | B1 | * | 11/2004 | Long | 242/554.2 |
| 6,877,943 | B1 | * | 4/2005 | Lehrieder et al. | 414/278 |
| 6,948,901 | B1 | * | 9/2005 | Allemann | 414/279 |

FOREIGN PATENT DOCUMENTS

| | | | | |
|---|---|---|---|---|
| DE | 2952729 | A | * | 7/1981 |
| DE | 38 24 328 | C1 | | 12/1989 |
| DE | 43 44 743 | A1 | | 6/1995 |
| DE | 196 51 205 | A1 | | 6/1998 |
| DE | 39 10 444 | C3 | | 10/1998 |
| DE | 198 60 475 | A1 | | 7/2000 |
| EP | 0 995 706 | A1 | | 9/1999 |
| JP | 01267271 | A | * | 10/1989 |
| JP | 02193850 | A | * | 7/1990 |
| JP | 07275161 | A | * | 10/1995 |
| JP | 10-181959 | | | 7/1998 |
| JP | 10181959 | A | * | 7/1998 |
| JP | 11293530 | A | * | 10/1999 |
| NL | 8802239 | A | * | 4/1990 |
| WO | WO 95/20537 | | | 8/1995 |
| WO | WO 00/68115 | | | 11/2000 |

* cited by examiner

DEVICE FOR CONVEYING EMPTY ROLLS

FIELD OF THE INVENTION

The present invention is directed to a device for disposing of residual or empty rolls. The residual or empty rolls are removed from a roll changer and placed in a movable container.

BACKGROUND OF THE INVENTION

So-called roll changers, in which at least two paper rolls can be simultaneously clamped and supported, are employed for supplying web-fed rotary printing presses with printing paper. The paper web printed by the web-fed printing press is pulled off a paper web roll in the roll changer. As soon as this paper web roll is used up, a roll change is performed in the roll changer, so that thereafter the paper web is pulled off a fresh paper web roll. Following the roll change, the empty paper web supporting roll core must be removed from the roll changer in order to make space for a fresh paper roll.

Residual or empty roll core containers, which are brought to the roll changer by suitable transport means, are used for removing the residual or empty roll cores from the roll changer. After the fastening of the residual roll core in the roll changer has been released, the residual roll core falls into the residual roll core container, which thereafter is moved back again into a parked position. Such a movable residual roll core container is described in DE 198 60 475 A1, for example.

In generally known installations for the disposal of residual roll cores, the residual roll cores are temporarily stored in the residual roll core containers. The residual roll core containers must be emptied no later than the time at which the residual roll core container is completely filled with residual roll cores. This emptying is performed manually in prior installations. This means that the residual roll cores are removed manually from the residual roll core container, which manual roll core removal constitutes a considerable processing outlay.

DE 196 51 205 A1 shows a device for the disposal of the empty winding cores from roll changers. A core collecting container is lifted.

WO 95/20537 and EP 0 995 706 A1 describe roll changers with residual roll core disposal.

DE 39 10 444 C3 discloses a roll transporting system. A disposal station for residual roll cores is arranged outside of the roll storage facility.

DE 38 24 328 C1 shows a storage shelf for paper rolls.

SUMMARY OF THE INVENTION

The object of the present invention is directed to providing a device for transporting residual or empty roll cores.

In accordance with the present invention, this object is attained by the provision of a device for transporting residual or empty rolls or roll cores, which have been removed from a roll changer, to a discharge station. At least one empty roll core or residual roll container is provided and it moves between the roll changer and the discharge station. A pivot device is usable for pivoting of the roll core container about a horizontal pivot shaft.

The advantages to be gained by the present invention lie, in particular, in that the emptying of the residual roll containers in the discharge station takes place automatically, so that a reduction of manual work processes is possible. To this end, an additional collecting container is provided in the discharge station, into which collecting container the residual roll containers are automatically emptied.

It is, of course, necessary to also empty the collecting container itself after it has received a specified number of residual rolls. It is therefore particularly advantageous, in accordance with the present invention, if the collecting container has a sufficiently large storage capacity so that several residual roll containers can be emptied into the collecting container without an intermediate emptying of the collecting container. As a result, it is possible to temporarily store a large number of residual rolls in the collecting container.

The manner used for providing the conveying movement, which is necessary for emptying the residual rolls out of the residual roll container, is basically a matter of choice. For example, gripper devices, with appropriate movement kinematics, are conceivable, by the use of which gripper devices the residual rolls are transferred from the residual roll container into the collecting container. Emptying of the residual roll container can be performed particularly simply and rapidly, if the residual roll container is arranged higher, in the discharge station, than the collecting container. It is thus possible, in this arrangement, for the residual rolls to be transferred to the lower situated collecting container merely because of their inherent weight, without requiring separate drive mechanisms for providing a conveying movement to the residual rolls.

The difference in levels, which is required between the residual roll container and the collecting container in the discharge station, can be provided by the utilization of suitable structural measures, for example, so that the collecting containers are parked on a level that is lower than the residual roll containers. However, considerable structural steps are necessary to attain this solution. To avoid the need for providing different levels in a building, it is possible, in an alternative manner, to provide a lifting device in the discharge station, with which lifting device the residual roll containers can be lifted. In other words, in the normal case, the residual roll containers are located on the same level as the collecting container, and are only lifted to a higher level by use of the lifting device, for emptying.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
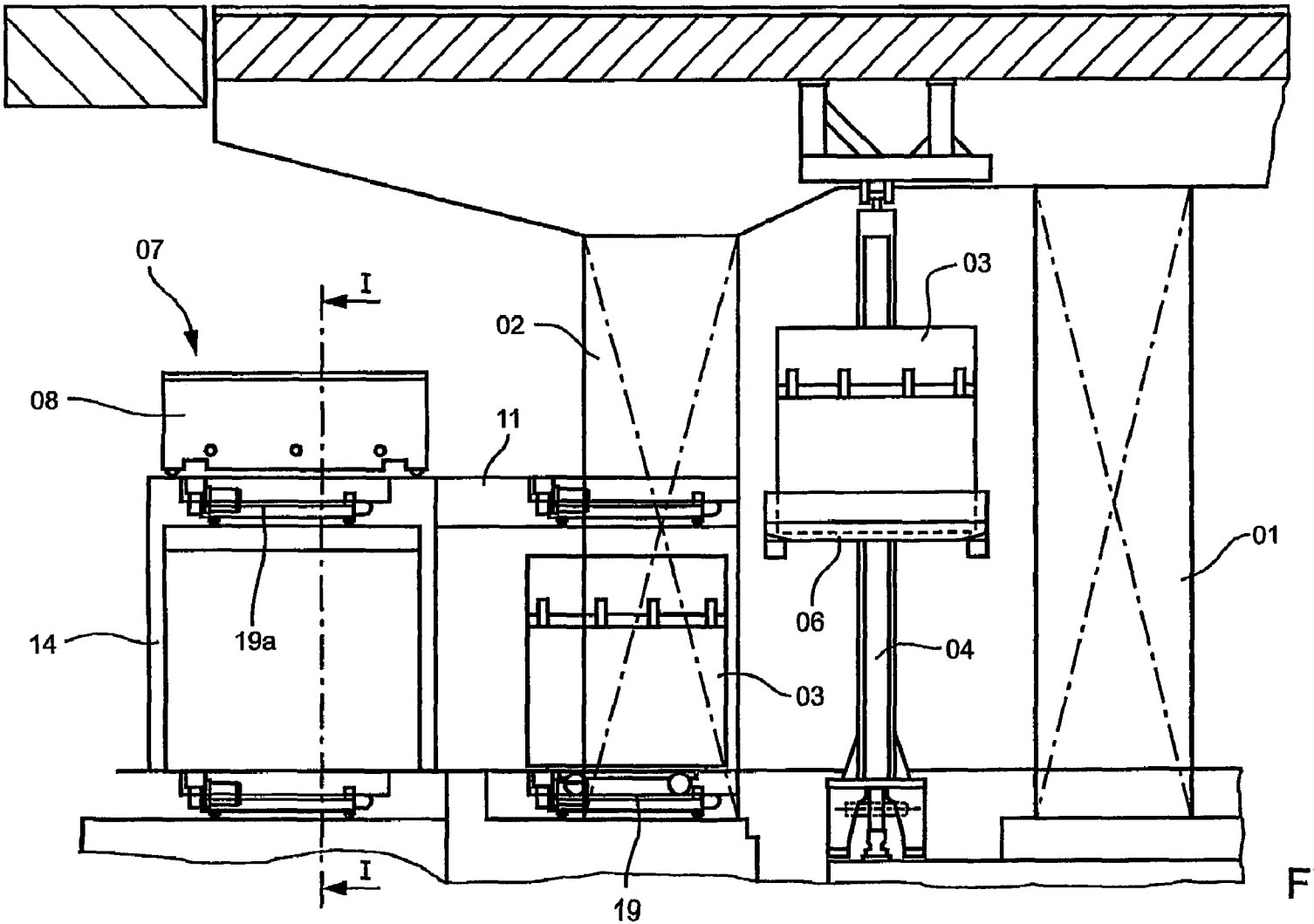
FIG. 1, a side elevation view, party in cross-section of a discharge station for emptying residual roll containers in accordance with the present invention, in FIG. 2, a portion of the discharge station in accordance with FIG. 1 taken along the section line I—I of FIG. 1 and showing the discharge station in a first operating stage, and in FIG. 3, the discharge station of FIG. 2 in a second operating stage.

Two depots with shelves 01, 02 are provided opposite each other in a building of a print shop, as seen in FIG. 1 in which rolls 03 of material, for example paper rolls 03, can be stored on two levels situated above each other. The paper rolls 03 can be stored in, or can be removed from the depots with shelves 01, 02 by the use of a lifting device, such as a shelf vehicle 04. For this purpose, the lifting device 04, for example the shelf vehicle 04, can be moved horizontally between the depots with shelves 01, 02, and is equipped with a vertically displaceable carriage 06. At an end of the depots with shelves 01 or 02, the paper rolls 03 can be transferred to transport vehicles 19, which transport vehicles 19 are seated in, or supported on an underfloor rail system and which vehicles 19 can be driven by drive chains. The paper rolls 03 can then be transported to a subsequent processing station and then to the roll changers by the use of the driven transport vehicles 19.

Figure 2:
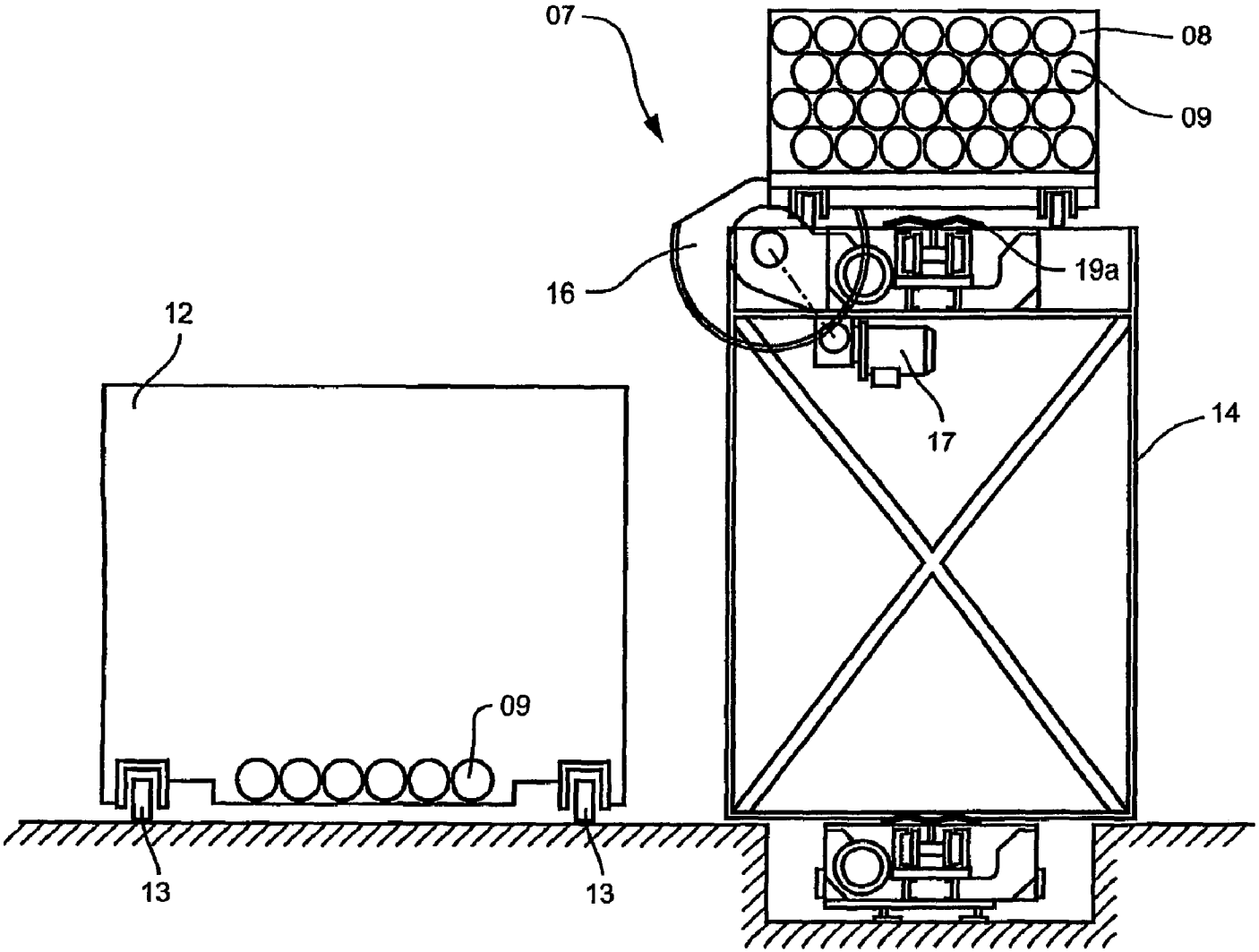

A discharge station 07 is arranged at the side of the depot with shelves 02, by the use of which discharge station 07, a residual roll container 08 can be emptied into a collecting container 12, as seen in FIG. 2. Following a roll change at a roll changer, which is not specifically represented, the used up residual rolls 09, shown in FIG. 2 are received in the residual roll containers 08. At least by the time when the residual roll container 08 has been filled with residual rolls 09, so that no more residual rolls 09 can be received, the residual roll container 08 is transported, by the use of a transport vehicle 19, to the entry station of the shelf vehicle 04. At that entry station, the residual roll container 08 is removed from the transport vehicle 19 and is received by the carriage 06 of the shelf vehicle 04. Thereafter, the carriage 06 is conveyed to a transfer station 11, which is integrated into the first floor of the depot with shelves 02.

A conveying track is provided between the transfer station 11 and the discharge station 07, by the use of which conveying track the residual roll containers 08 can be conveyed in both directions between the transfer station 11 and the discharge station 07. For this purpose, a transport vehicle 19*a* is also provided in the conveying track, whose construction and function corresponds to the other transport vehicles 19 for conveying the paper rolls 03. As soon as the carriage 06 of the shelf vehicle 04 has arrived at the transfer station, the residual roll container 08 is transferred to the transport vehicle 19*a* and is conveyed by it to the discharge station 07.

Figure 3:
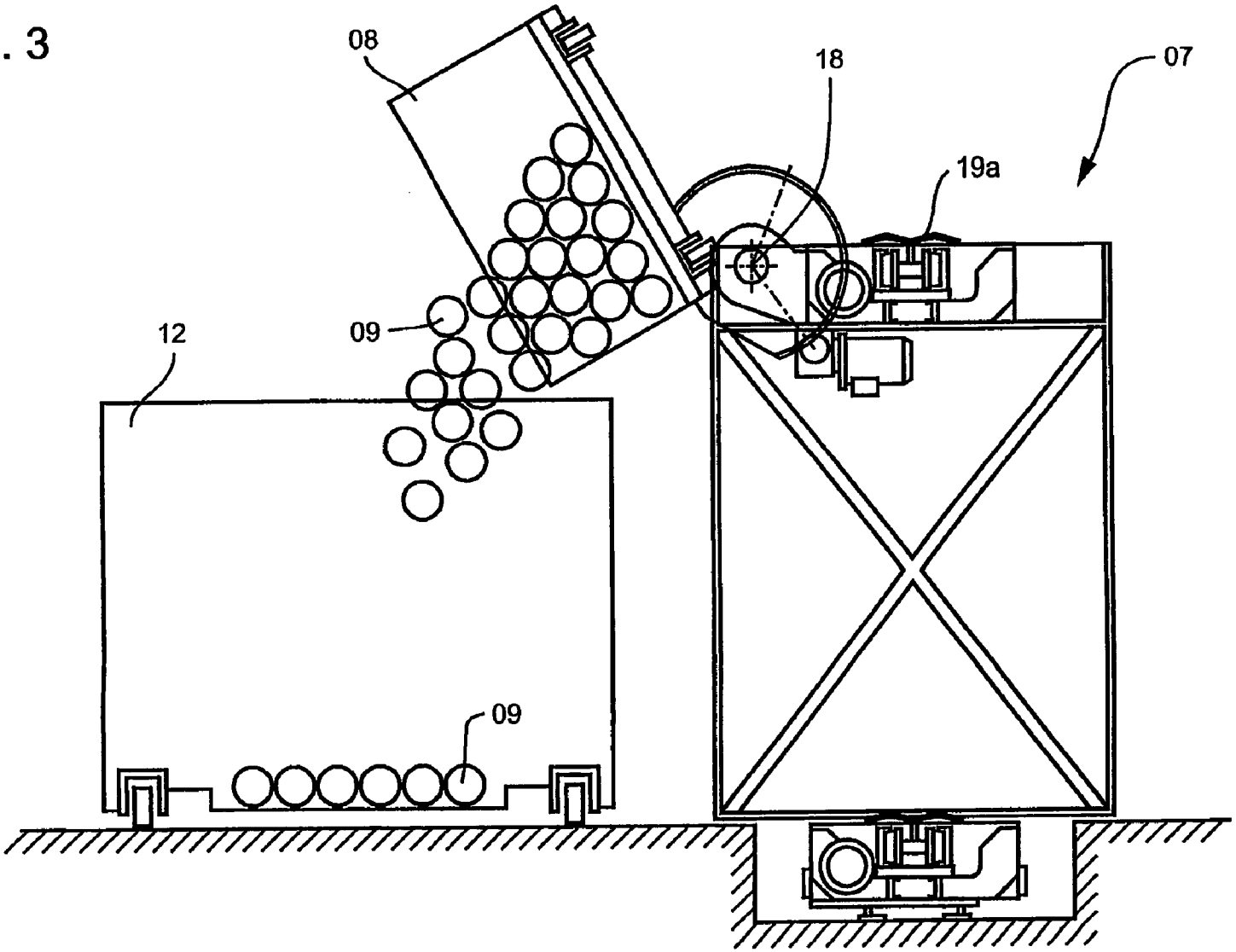

The functioning of the discharge station 07, when emptying the residual roll containers 08, can be seen in FIGS. 2 and 3.

A collecting container 12, which is embodied as a container 12 into which a large number of residual rolls 09 can be placed, can be arranged at a side of the discharge station 07. The collecting container 12 can be moved on rollers 13 and is suited for being arranged on an appropriately configured truck.

The discharge station 07 has a portal frame 14, which carries the residual roll container 08 at a level extending above the upper edge of the collecting container 12. A pivot device 16 is furthermore provided at the discharge station, which pivot device 16 can be driven by a drive motor 17.

As soon as the residual roll container 08 has been completely driven into the discharge station 07, it is locked against the pivot device 16. Thereafter, the pivot device 16 is driven by the drive motor 17 in such a way that the residual roll container 08 is pivoted around a horizontal shaft 18, as seen in FIG. 3, sufficiently far so that the residual rolls 09 fall, because of their inherent weight, and under the influence of gravity, into the collecting container 12 located below. When the residual roll container 08 has been emptied, it is again fixed in place on the transport vehicle 19*a* and is returned, in the reverse order through the transfer station 11, to the carriage 06 of the shelf vehicle 04. Then the shelf vehicle 04 transports the empty residual roll container 08 back to an underfloor arranged transport vehicle 19, so that the residual roll container 08 can again be used for the receipt of residual rolls 09 at the roll changers.

While a preferred embodiment of a device for conveying empty rolls, in accordance with the present invention, has been set forth fully and completely hereinabove, it will be apparent to one of skill in the art that various changes in, for example the overall sizes of the containers, the type of printing press with which they are used, and the like could be made without departing from the true spirit and scope of the present invention which is accordingly to be limited only by the following claims.

What is claimed is:

1. A system for transporting residual rolls removed from at least one roll changer in a printing press comprising:

at least one transportable residual roll container adapted to receive a plurality of residual rolls from the at least one roll changer;

a discharge station adapted to remove said plurality of residual rolls from said at least one transportable residual roll container;

a collecting container in said discharge station and into which said plurality of residual rolls from said at least one transportable residual roll container can be emptied, said collecting container having a storage capacity sufficient to receive said plurality of residual rolls from each of a plurality of said transportable residual roll containers, said collecting container being supported at a first level;

a transportable residual roll container lifting device in said discharge station and adapted to lift said at least one transportable residual roll container to a second level higher than said first level;

a transport vehicle adapted to transport said at least one transportable residual roll container between said discharge station and the at least one roll changer; and an underfloor rail system, said transport vehicle being supported for movement on said underfloor rail system.

2. The system of claim 1 further including a depot with shelves adapted for the storage of rolls of paper, said discharge station being a part of said depot.

3. The system of claim 2 further including a shelf vehicle adapted to convey rolls of paper into and out of said depot.

4. The system of claim 2 further including a transfer station in said depot with shelves and adapted to convey said at least one transportable residual roll container to said discharge station.

5. The system of claim 4 further including a conveying track in said underfloor rail system and connecting said transfer station and said discharge station and along which said transport vehicle conveying said transportable residual roll container can be conveyed.

6. The system of claim 1 wherein said residual rolls are conveyable by gravitational force from said transportable residual roll container into said collecting container.

7. The system of claim 1 further including a pivot device in said discharge station and adapted to pivot said at least one transportable residual roll container about a horizontal shaft.

8. The system of claim 1 further wherein said collecting container is movable.

9. The system of claim 1 further wherein said collecting container is adapted to be transported on a vehicle.

10. The system of claim 1 further including plural ones of said transport vehicles which are each adapted to convey rolls of material to the at least one roll changer, each said transport vehicle having a construction and function corresponding to a construction and function of each other one of said transport vehicles.

* * * * *